US007239093B2

(12) United States Patent
Hsieh

(10) Patent No.: US 7,239,093 B2
(45) Date of Patent: Jul. 3, 2007

(54) SYSTEM AND METHOD FOR CONTROLLING LUMINANCE OF AN LED LAMP

(75) Inventor: Kuan-Hong Hsieh, Tu-Cheng (TW)

(73) Assignee: Hon Hai Precision Industry Co., Ltd., Tu-cheng, Taipei Hsien (TW)

( * ) Notice: Subject to any disclaimer, the term of this patent is extended or adjusted under 35 U.S.C. 154(b) by 39 days.

(21) Appl. No.: 11/177,632

(22) Filed: Jul. 8, 2005

(65) Prior Publication Data

US 2006/0017409 A1 Jan. 26, 2006

(30) Foreign Application Priority Data

Jul. 9, 2004 (TW) ..... 93120630 A

(51) Int. Cl.
*H05B 37/02* (2006.01)
*H01J 1/60* (2006.01)

(52) U.S. Cl. ..... 315/291; 315/129; 315/360; 116/201

(58) Field of Classification Search ..... 315/129, 315/246, 291, 293, 299, 307, 308, 360; 116/200, 116/201

See application file for complete search history.

(56) References Cited

U.S. PATENT DOCUMENTS 4,112,440 A * 9/1978 Kanemaru ..... 396/290
6,472,946 B2 * 10/2002 Takagi ..... 332/109
6,771,281 B2 * 8/2004 Takagi ..... 345/690
2002/0178388 A1 * 11/2002 Huppi et al. ..... 713/300
2004/0046720 A1 * 3/2004 Nagai et al. ..... 345/82
2004/0196151 A1 10/2004 Smith ..... 340/539.17
2005/0007035 A1 * 1/2005 Sloan et al. ..... 315/291
2005/0122060 A1 * 6/2005 Yu et al. ..... 315/247

* cited by examiner

*Primary Examiner*—Thuy V. Tran
(74) *Attorney, Agent, or Firm*—Morris Manning & Martin LLP; Tim Tingkang Xia, Esq.

(57) ABSTRACT

A system for controlling luminance of an LED (Light Emitting Diode) lamp includes an MCU (3), an LED circuit (4), an LED lamp (5), and a display (6). The MCU controls the LED circuit to adjust a luminance value of the LED lamp. The MCU includes: a CPU (31) for monitoring a status of the associated display, generating a corresponding PWM (Pulse-Width Modulation) pulse when the system operates in different working phases, and transmitting the corresponding PWM pulse to the LED circuit via a PWM pin (32); a timer (33) for recording a duration of a user operating a control button (61); and a memory (34) for storing control programs. The LED circuit sets a luminance value of the LED lamp according to the PWM pulses. A related method is also provided.

12 Claims, 5 Drawing Sheets

SYSTEM AND METHOD FOR CONTROLLING LUMINANCE OF AN LED LAMP

BACKGROUND OF THE INVENTION

1. Field of the Invention

The present invention relates to electronic systems and methods for controlling luminance of light sources, and particularly to a system and method for controlling luminance of an LED (Light Emitting Diode) lamp as an indicator.

2. Related Art

Recently indicators that use LEDs have been introduced in various electronic apparatuses. The electronic apparatuses employ the LED lamp as an indicator for indicating a particular working state. For example, when the LED lamp is lighted on, that means the electronic apparatus is powered on; alternatively, when the LED is black out, that means the electronic apparatus is shut down. The brightness of the LED lamp depends on the current flow through it. That is, the luminance value of the LED lamp is proportional to LED current. Therefore, correspondingly to a particular working state, it is necessary to provide a corresponding current control circuit to obtain a particular luminance value of the LED lamp. In other words, in order to indicate various working states, there are provided many LED lamps and the corresponding current control circuits as well as the working states. As result, the cost and complexity of manufacture associated with the electronic apparatuses are increased. Therefore, there is a need for a system and a method for effectively controlling a LED lamp to indicate different working states.

In a typical lighting system such as a backlight module used for a liquid crystal display (LCD), to control brightness thereof, a driver circuit increases or decreases a drive current supplied to an indicator lamp. Generally, the drive current is adjusted in relation to the ambient light environment and according to user preferences. A poorly lit environment usually requires less brightness, and thus a lower drive current, than a brightly lit environment. Different users may have different desired brightness levels. The brightness may be changed automatically in response to the environment and/or changed manually. However, such changes may rapidly reduce the useful operating lifetime of the lamp. Many control schemes like PWM (Pulse-Width Modulation) duty cycle controls have been implemented in order to control lamp lighting. PWM duty cycle control of the lamp luminance is accomplished by duty cycle control of the lamp on a time basis relative to a total time period. During the "on" time of the PWM signal, a higher frequency current supply is provided to the lamp.

U.S. Pat. No. 6,388,388 published on Dec. 27, 2000 provides a "Brightness control system and method for a backlight display device using backlight efficiency." The brightness control system uses the efficiency of the backlight in order to achieve a desired brightness or luminance for the backlight display device. At each lamp temperature, the luminance is linearly proportional to a desired drive current for the backlight. By using the measured lamp temperature and known backlight efficiency to derive a desired lamp current and then generating the desired lamp current, the brightness control system can maintain the desired brightness throughout the dynamic range of operation of the backlight display device. The desired lamp current may be computed in a digital micro controller in response to a digitized lamp temperature measurement. This lamp current value is converted to an analog signal having a magnitude that creates the desired average lamp current. The analog signal is coupled to an IC (integrated circuit) inverter as a brightness command. Although the lamp current necessary to create the desired illumination is known, however, the lamp current is adjusted based on the temperature thereof which may be affected by the ambient, so that the lamp current may be inaccurate. Thus, there is a need for a system and method for effectively controlling luminance of an LED lamp.

SUMMARY

A system for controlling luminance of an LED lamp in accordance with a preferred embodiment includes: a MCU (Micro-programmed Control Unit), an LED circuit, an LED lamp, and a display having a control input device. The MCU controls the LED circuit to adjust the luminance of the LED lamp. The MCU includes: a CPU (Central Processing Unit) for monitoring a status of the display, generating a corresponding PWM (Pulse-Width Modulation) pulse when the system operates in different working phases, and transmitting the corresponding PWM pulse to the LED circuit via a PWM pin; a timer for recording a duration of the user operating the control input device; and a memory for storing control programs. The LED circuit sets luminance of the LED lamp according to the PWM pulse.

In addition, a method for controlling luminance of an LED lamp is provided. The method includes the steps of: generating a first PWM pulse when an image signal from an image processor is received; transmitting the first PWM pulse to an LED circuit; adjusting a luminance value of the LED lamp according to the first PWM pulse; generating a second PWM pulse when a control signal from a control input device is received; transmitting the second PWM pulse to the LED circuit; and adjusting the luminance value of the LED lamp according to the second PWM pulse.

Other advantages and novel features will be drawn from the following detailed description with reference to the attached drawings, in which:

DETAILED DESCRIPTION OF THE EMBODIMENTS

The following acronyms, among others, are used in this description:

DRAM—dynamic random access memory

EPROM—erasable and programmable read-only memory

SRAM—static random access memory

Figure 1:
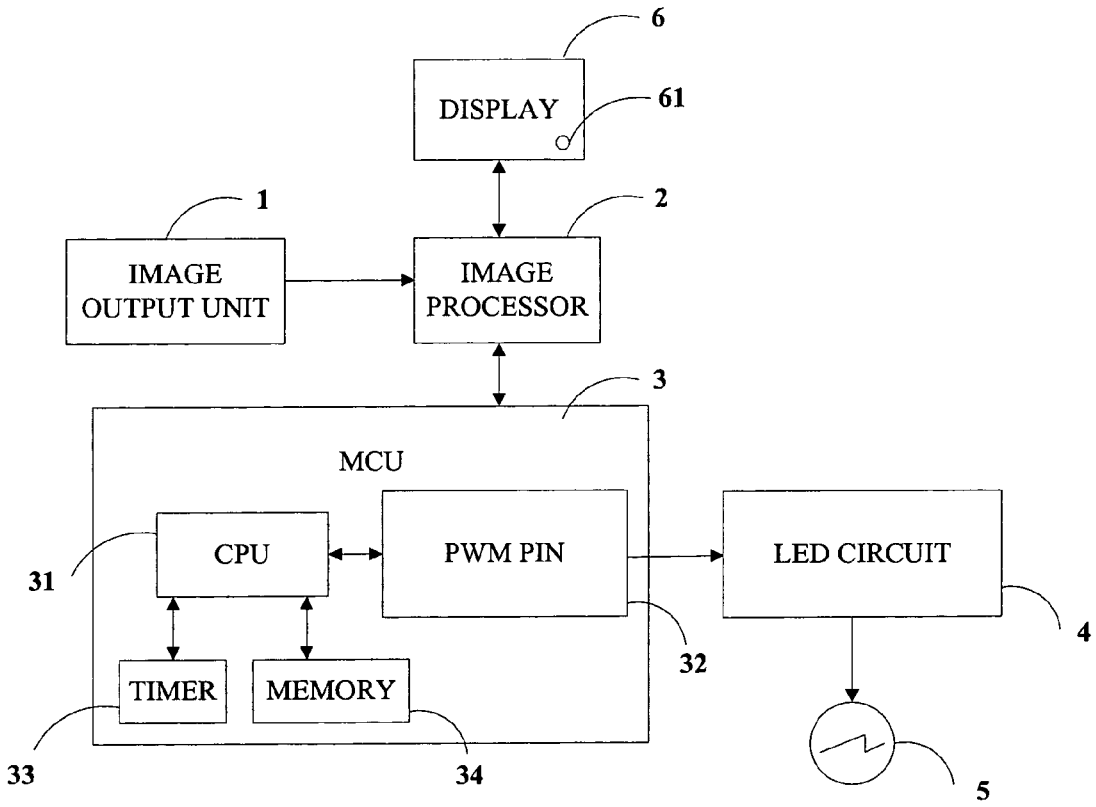
FIG. 1 is a block diagram of hardware infrastructure of a system for controlling luminance of an LED lamp in accordance with a preferred embodiment of the present invention.

FIG. 1 is a block diagram of hardware infrastructure of a system for controlling luminance of an LED (Light Emitting Diode) lamp (hereinafter, "the system") in accordance with a preferred embodiment of the present invention. The system includes an image output unit 1, an image processor 2, an MCU (Micro-programmed Control Unit) 3, an LED circuit 4, an LED lamp 5 as an indicator of the system, and a display 6. The display 6 includes a control button 61 therein. The control button 61 is provided for generating a control signal in accordance with manipulation by a user. The image output unit 1 is provided for outputting an image signal to the image processor 2. The image processor 2 processes the received image signal so as to adjust parameters of an image, such as size, scaling, contrast, brightness, and the like. Then the image processor 2 transmits the processed image signal to the display 6.

The MCU 3 controls the LED circuit 4 to adjust a luminance of the LED lamp 5. For example, when the system is powered on, the MCU 3 controls the LED circuit 4 to turn on the LED lamp 5 and the luminance value thereof reaches its maximum value. When the system enters an initialization phase according to a function such as that shown in FIG. 2 but has not yet entered a normal working phase, the MCU 3 controls the LED circuit 4 to gradually decrease the luminance value of the LED lamp 5 to a certain percent, for example, 40 percent, of its maximum value. When the system enters the normal working phase and the control button 61 is not operated, the MCU 3 controls the LED circuit 4 to maintain the luminance value of the LED lamp 5 at 40 percent of its maximum value. Alternatively, when the system enters the normal working phase and the control button 61 is operated, the MCU 3 controls the LED circuit 4 to adjust the luminance value of the LED lamp 5 according to a function such as that shown in FIG. 3. When the system is shut down, the MCU 3 controls the LED circuit 4 to turn off the LED lamp 5 and the luminance value thereof reaches its minimum value.

The MCU 3 includes a CPU (Central Processing Unit) 31, a PWM (Pulse-Width Modulation) pin 32, a timer 33, and a memory 34. The CPU 31 generates a corresponding PWM (Pulse-Width Modulation) pulse and thus to adjust the luminance of the LED lamp 5 based on the working phases of the system and the control button 61, and transmitting the corresponding PWM pulse to the LED circuit 4 via the PWM pin 32. When the system enters the initialization phase, the CPU 31 generates a first PWM pulse. When the system enters the normal working phase and the control button 61 receives the user's operation, the CPU 31 generates a second PWM pulse. The timer 33 records a duration of the user operating the control button 61. The memory 34 stores control programs for implementing the system. The memory 34 may be a ROM (Read-only Memory), a RAM (Random Access Memory), a volatile memory (i.e., a DRAM, an SRAM, or the like), or a non-volatile memory (i.e., an EPROM, a Flash memory, or the like). The LED circuit 4 adjusts a luminance value of the LED lamp 5 according to the PWM pulses received from the CPU 31. That is, when receiving the first PWM pulse, the LED circuit 4 gradually decreases the luminance value of the LED lamp 5 to 40 percent of its maximum value and maintains the luminance value referred to a first function such as that shown in FIG. 2. Alternatively, when receiving the second PWM pulse, the LED circuit 4 adjusts the luminance value of the LED lamp 5 according to a second function such as that shown in FIG. 3.

Figure 2:
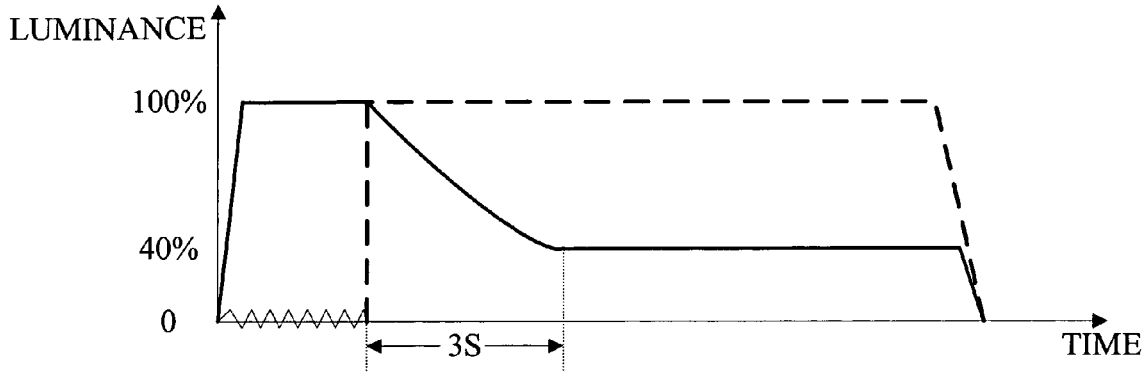
FIG. 2 is a graph of luminance versus time when the system of FIG. 1 operates in different working phases.

FIG. 2 is a graph of luminance versus time when the system operates in different working phases. In FIG. 2, the x-axis represents elapsed time, the y-axis represents the luminance value of the LED lamp 5, and the curve illustrates a first functional relationship between the elapsed time and the luminance value. In a first working phase, the system is powered on. The CPU 31 controls the LED circuit 4 to turn on the LED lamp 5, and the luminance value of the LED lamp 5 steadily reaches its maximum value, namely 100 percent. In a second working phase, the system enters the initialization phase. The CPU 31 detects the initialized image signal from the image output unit 1. Then the MCU 3 generates a first PWM pulse, and transmits the first PWM pulse to the LED circuit 4 via the PWM pin 32. Thereupon, the LED circuit 4 gradually decreases the luminance value of the LED lamp 5 to, say, 40 percent of its maximum value. In a third working phase, the system is in the normal working state (i.e., the display 6 has received the initialized image signal) and the control button 61 is not operated, and the luminance value of the LED lamp 5 is maintained at 40 percent of its maximum value. In a fourth working phase, the system has been powered off. The luminance value of the LED lamp 5 steadily reaches its minimum value, namely zero.

Figure 3:
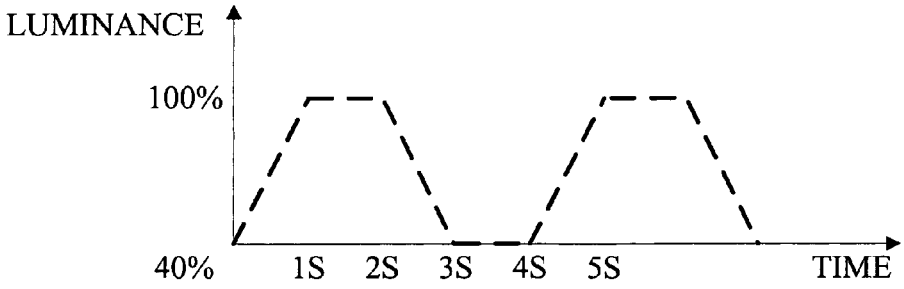
FIG. 3 is a graph of luminance versus time when a control button of a display of the system of FIG. 1 is operated in different operation phases.

FIG. 3 is a graph of luminance versus time when the control button 61 is operated in different clock periods. In FIG. 3, the x-axis represents elapsed time, the y-axis represents the luminance value of the LED lamp 5, and the curve illustrates a second function relationship between the elapsed time and the luminance value. In a first length of time such as a first clock period, the MCU 3 controls the LED circuit 4 to steadily increase the current luminance value (i.e., 40 percent of its maximum value) of the LED lamp 5 to its maximum value. In a second length of time such as a second clock period, the LED circuit 4 maintains the luminance value of the LED lamp 5 at its maximum value. In a third length of time such as a third clock period, the LED circuit 4 gradually decreases the luminance value of the LED lamp 5 to the foregoing luminance value (i.e, 40 percent of its maximum value). In a fourth length of time such as a fourth clock period, the LED circuit 4 maintains the luminance value of the LED lamp 5 at the foregoing luminance value. Throughout the above-described four lengths of time, namely the four clock periods, the LED lamp 5 is displayed in a flashing mode so as to indicate that a user is operating the control button 61. In further successive clock periods in which the control button 61 is still operated, the LED circuit 4 repeats the above-described management procedures to control the luminance of the LED lamp 5.

Figure 4:
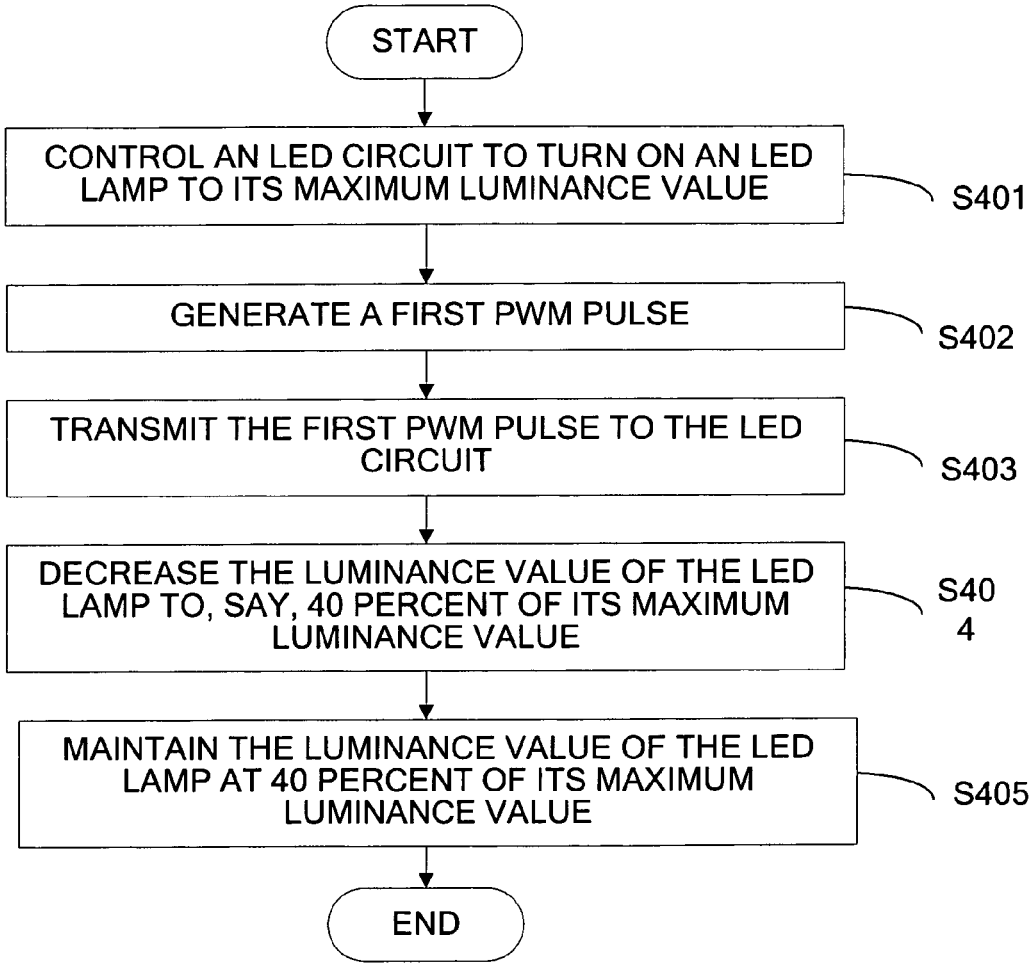
FIG. 4 is a flowchart of adjusting luminance of an LED lamp when the system of FIG. 1 operates in different working phases.

FIG. 4 is a flowchart of adjusting the luminance of the LED lamp 5 when the system operates in different working phases. In step S401, the system is powered on, and the CPU 31 controls the LED circuit 4 to turn on the LED lamp 5 and maintain the LED lamp 5 at its maximum luminance value. In step S402, the CPU 31 detects the image output unit 1 is outputting the initialized image signals to the image processor 2; that is, the system is staying in an initialization phase. The CPU 31 generates a first PWM pulse. In step S403, the CPU 31 transmits the first PWM pulse to the LED circuit 4 via the PWM pin 32. In step S404, the LED circuit 4 decreases the luminance value of the LED lamp 5 to a particular fraction of the maximum luminance value (i.e., 40 percent of its maximum value in the illustrated embodiment). In step S405, the CPU 31 detects the display 6 has received the initialized image signal, that is, the system is in a normal working phase. The LED circuit 4 maintains the luminance value of the LED lamp 5 at the particular fraction of the maximum luminance value, whereupon the procedure is ended.

Figure 5:
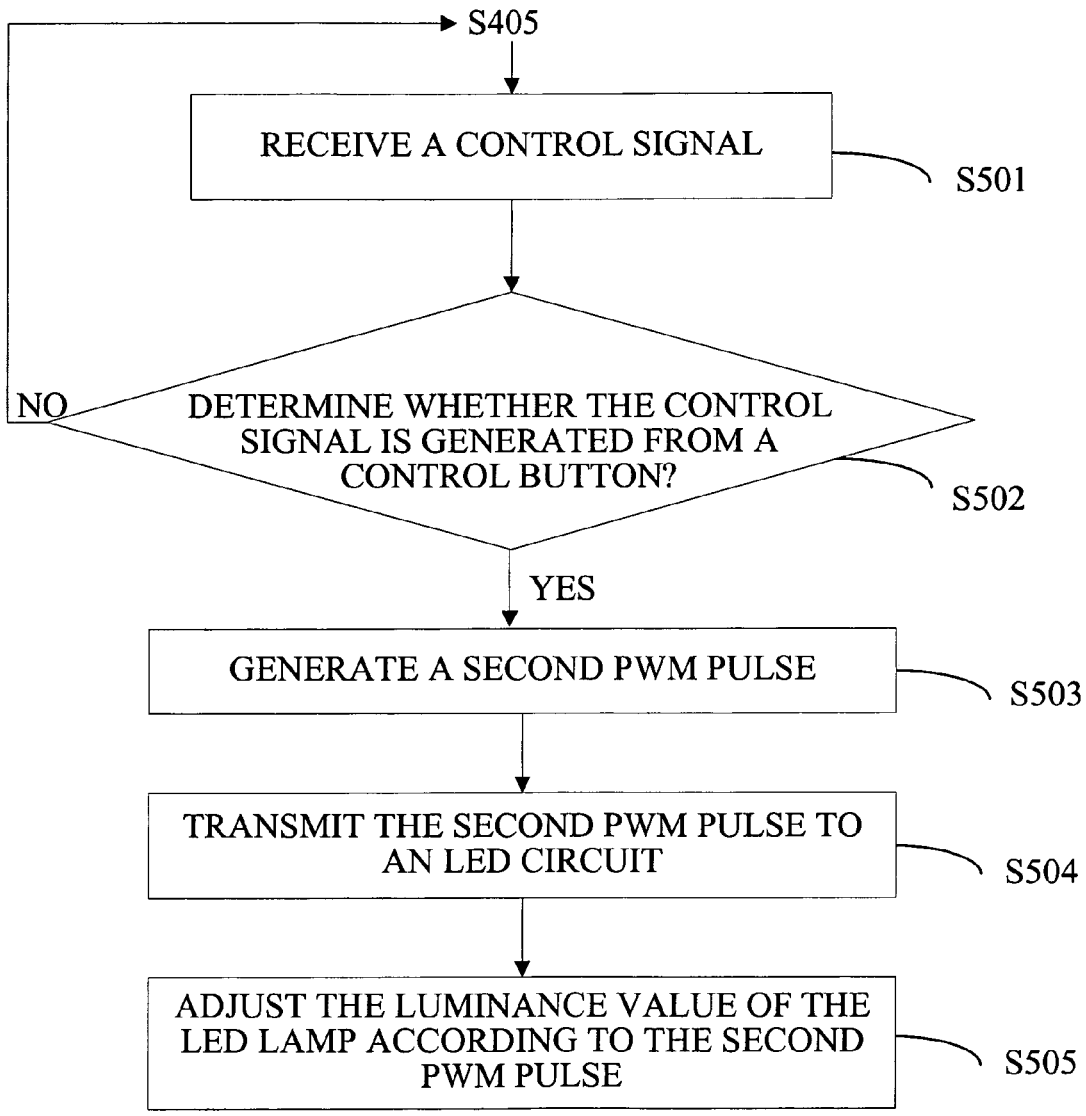
FIG. 5 is a flowchart of adjusting luminance of an LED lamp when the control button of the display of the system of FIG. 1 is operated in different clock periods.

FIG. 5 is a flowchart of adjusting luminance of the LED lamp 5 when the control button 61 is operated in different clock periods. In step S501, the system is in a normal working phase. The CPU 31 receives a control signal. In step S502, the CPU 31 determines whether the control signal is generated from the control button 61, that is, the CPU 31 determines whether the control button 61 has received a user operation. If the control signal is not from the control button 61, the procedure returns to step S405 described above. Otherwise, if the control signal is from the control button 61, in step S503, the MCU 3 generates a second PWM pulse. In step S504, the CPU 3 transmits the second PWM pulse to the LED circuit 4 via the PWM pin 32. In step S505, the LED circuit 4 adjusts the luminance value of the LED lamp 5 according to the second PWM pulse.

Figure 6:
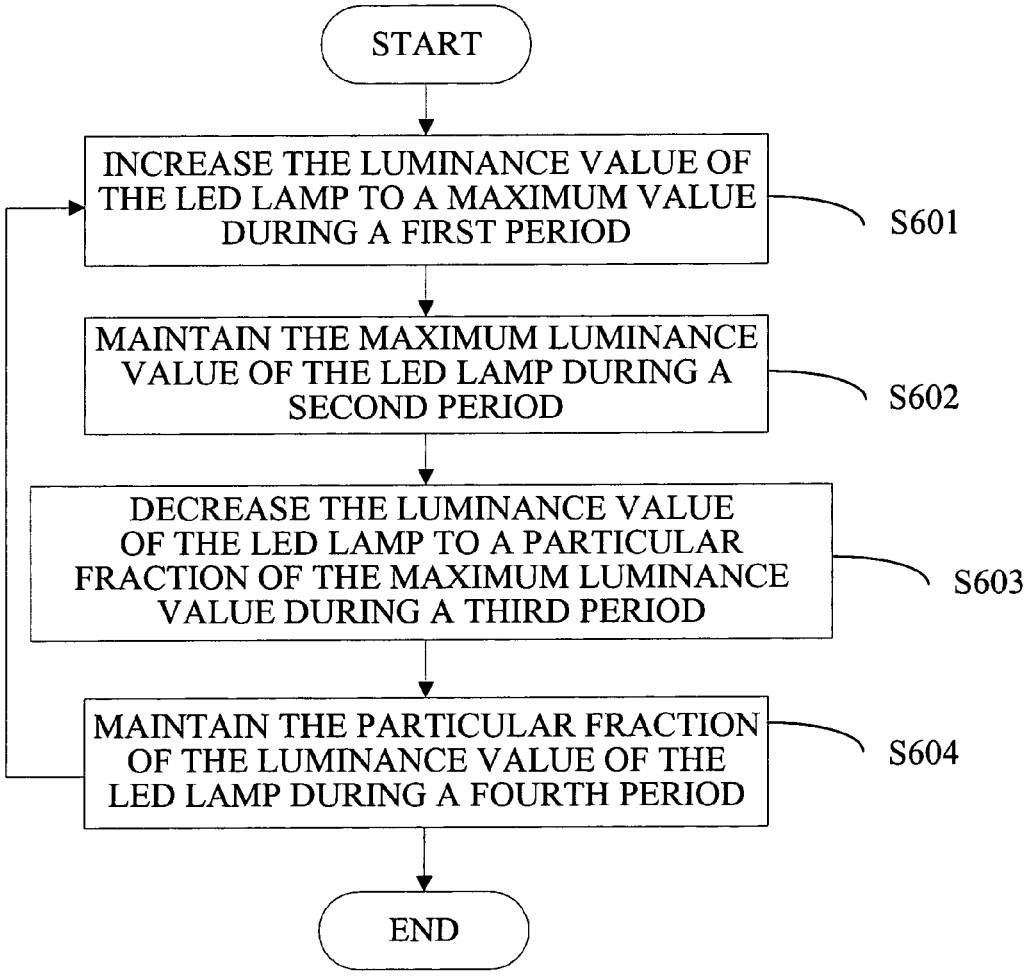
FIG. 6 is a flowchart of details of one step of FIG. 5, namely adjusting a luminance value of an LED lamp according to a second PWM pulse.

FIG. 6 is a flowchart of details of step S505 of FIG. 5, namely adjusting the luminance value of the LED lamp 5 according to the second PWM pulse. In step S601, the LED circuit 4 steadily increases the luminance value of the LED lamp 5 over a first length of time up to the maximum luminance value. In step S602, the LED circuit 4 maintains the maximum luminance value of the LED lamp 5 throughout a second length of time. In step S603, the LED circuit 4 gradually decreases the luminance value of the LED lamp 5 over a third length of time down to a particular fraction of the maximum luminance value. In step S604, the LED circuit 4 maintains the particular fraction of the luminance value of the LED lamp 5 throughout a fourth length of time.

Although the present invention has been specifically described on the basis of a preferred embodiment and preferred methods, the invention is not to be construed as being limited thereto. Various changes or modifications may be made to the embodiment and methods without departing from the scope and spirit of the invention.

I claim:

1. A system for controlling luminance of an LED (Light Emitting Diode) lamp, the system comprising an MCU (Micro-programmed Control Unit), an LED circuit, an LED lamp, and a display having a control input device, wherein:

the MCU controls the LED circuit to adjust a luminance value of the LED lamp, the MCU comprising:

a first processor for monitoring a status of the display, generating a corresponding PWM (Pulse-Width Modulation) pulse when the system operates in different working phases, and transmitting the corresponding PWM pulse to the LED circuit;

a timer for recording a duration of a user operating the control input device; and a memory for storing control programs; and the LED circuit is for setting a luminance of the LED lamp according to the PWM pulse.

2. Thc system as claimed in claim 1, further comprising an image output unit for outputting an image signal.

3. The system as claimed in claim 1, further comprising an image processor for receiving an image signal and adjusting an image accordingly.

4. The system as claimed in claim 1, wherein the memory is selected from a group consisting of a ROM (Read-Only Memory), a RAM (Random Access Memory), a volatile memory, and a non-volatile memory.

5. The system as claimed in claim 1, wherein the first processor transmits the corresponding PWM pulse to the LED circuit via a PWM pin.

6. The system as claimed in claim 3, wherein when the first processor receives an image signal from the image processor, the first processor generates a first PWM pulse, and when the first processor receives a control signal from the control input device, the first processor generates a second PWM pulse.

7. A method for controlling luminance of an LED (Light Emitting Diode) lamp, comprising the steps of:

generating a first PWM (Pulse-Width Modulation) pulse when an image signal from an image processor is received;

transmitting the first PWM pulse to an LED circuit;

adjusting a luminance value of the LED lamp according to the first PWM pulse;

generating a second PWM pulse when a control signal from a control input device is received;

transmitting the second PWM pulse to the LED circuit; and adjusting the luminance value of the LED lamp according to the second PWM pulse.

8. The method according to claim 7, wherein the step of adjusting the luminance value of the LED lamp according to the first PWM pulse comprises the step of: decreasing the luminance value of the LED lamp to a predetermined fraction of a maximum luminance value.

9. The method according to claim 7, wherein the step of adjusting the luminance value of the LED lamp according to the second PWM pulse comprises the steps of:

increasing the luminance value of the LED lamp to a maximum luminance value during a first length of time;

maintaining the maximum luminance value of the LED lamp during a second length of time;

gradually decreasing the luminance value of the LED lamp to a predetermined fraction of the maximum luminance value during a third length of time; and maintaining the predetermined fraction of the luminance value of the LED lamp during a fourth length of time.

10. A method for controlling luminance of an indicator of a device, comprising the steps of:

presetting a first Pulse-Width Modulation (PWM) pulse corresponding to a first controllable condition and a second PWM pulse corresponding to a second controllable condition; and adjusting luminance of said indicator according to said first PWM pulse under said first controllable condition, and according to said second PWM pulse under said second controllable condition, wherein said first controllable condition is that an image processor of said device receives image signals for said device, and said second controllable condition is that a control button of said device is manipulated by a user of said device.

11. The method according to claim 10, further comprising the step of maintaining luminance of said indicator as a predetermined fraction of a full luminance value thereof under other conditions that neither said first controllable condition nor said second controllable condition meets.

12. The method according to claim 10, wherein said indicator is a Light Emitting Diode (LED) lamp of said device controlled by an LED circuit respondent to said first and second PWM pulses.

* * * * *